US006711375B1

(12) United States Patent
Itoh

(10) Patent No.: US 6,711,375 B1
(45) Date of Patent: Mar. 23, 2004

(54) IMAGE FORMING APPARATUS AND METHOD OF SETTING UP THE SAME

(75) Inventor: Shinichi Itoh, Yokohama (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/319,503

(22) Filed: Dec. 16, 2002

(51) Int. Cl.[7] ..... G03G 15/08; G03G 21/10
(52) U.S. Cl. ..... 399/359; 399/258
(58) Field of Search ..... 399/24, 27, 53, 399/58, 120, 255, 256, 258, 260, 358, 359

(56) References Cited

U.S. PATENT DOCUMENTS 4,894,688 A * 1/1990 Taniguchi et al. ..... 399/359
5,848,342 A * 12/1998 Tanda ..... 399/358
6,526,252 B1 * 2/2003 Itoh et al. ..... 399/359
6,553,202 B2 * 4/2003 Tamaki et al. ..... 399/258

FOREIGN PATENT DOCUMENTS

JP 07-181792 * 7/1995
JP 11-95553 4/1999
JP 2002-131996 * 5/2002

OTHER PUBLICATIONS

U.S. patent application Ser. No. 09/975,975, Itoh et al., filed Oct. 15, 2001.
U.S. patent application Ser. No. 09/975,976, Itoh et al., filed Oct. 15, 2001.
U.S. patent application Ser. No. 09/976,147, Itoh et al., filed Oct. 15, 2001.

* cited by examiner

*Primary Examiner*—Sophia S. Chen
(74) *Attorney, Agent, or Firm*—Foley & Lardner

(57) ABSTRACT

The present invention relates to an image forming apparatus and a set-up method for the image forming apparatus for reusing recovered toner collected after toner is used in a developing device of the image forming apparatus by mixing the recovered toner with new toner. Before the image forming apparatus is initially set up, the developing device is in an evacuated state, and a transfer path of the recovered toner is filled with an initial developing agent. Then, when the image forming apparatus is initially set up, the initial developing agent is supplied into the developing device. It is preferable that a recovered toner sub-hopper be filled with the initial developing agent. When the image forming apparatus is initially set up, the initial developing agent is promptly supplied into the developing device by increasing an operation speed.

10 Claims, 8 Drawing Sheets

IMAGE FORMING APPARATUS AND METHOD OF SETTING UP THE SAME

BACKGROUND OF THE INVENTION

The present invention relates to an image forming apparatus and method of setting up the same for reusing recovered toner by mixing it with new toner, the apparatus and the method being applicable to an image forming apparatus and the like of, for example, a copying machine, printer, facsimile, and the like.

An image forming apparatus having a toner recycle device executes an image forming process such that the surface of a photosensitive drum is charged negatively, a latent image is formed by exposing the photosensitive drum with laser beams based on an image signal (a surface is charged with a potential), a visible image is formed by causing the latent image to absorb negatively charged toner, and the visible image is transferred onto a positively charged sheet and fixed thereon.

In this case, the toner is stored in a developing device as a developing agent mixed with a carrier. The developing device adheres a suitable amount of the developing agent on the surface of the charged photosensitive drum 2.

In the above image formation, toner, which was already used for image formation and collected for recycle (hereinafter, referred to as "recovered toner"), and new toner, which is not yet used for image formation (hereinafter, referred to as "new toner"), are used in mixture. That is, the recovered toner is recycled. The recovered toner is recycled by a toner recycle device.

Incidentally, when the image forming apparatus is used for the first time, the developing device must be filled with an initial developing agent. The following way are conventionally available as way for filling the developing device with the initial developing agent.

(1) When a product is shipped, the developing device is previously filled with the initial developing agent.

(2) When the product is shipped, a new toner hopper is filled with the initial developing agent, and the initial developing agent in the new toner hopper is supplied into the developing device when the product is used for the first time.

(3) A vessel (bottle, bag and the like) filled with the initial developing agent is put into the package of an image forming apparatus main body separately therefrom and charged into the developing device when the image forming apparatus is set up.

However, the respective way described above have the following problems.

(1) When the developing device is previously filled with the initial developing agent, there is a possibility that the developing agent leaks due to vibration and the like while it is transported. Since the developing device has a developing roller which ordinarily includes a large opening, the developing agent is apt to leak from the opening in the structure of the developing device. It is very difficult to prevent the leakage of the developing agent from the opening with a simple structure. While there is an example in which a shutter structure is employed to prevent the leakage, this structure is considerably expensive.

There is also a system for entirely sealing the developing roller. This system, however, is time-consuming because the seal member must be removed when the image forming apparatus is set up.

(2) When the new toner hopper is filled with the fresh developing agent, all the initial developing agent in the new toner hopper must be supplied into the developing device when the image forming apparatus is set up. New toner cannot be replenished while the initial developing agent remains in the new toner hoper. This is because when the new toner is resupplied while the initial developing agent remains, the ratio of the toner to the carrier changes.

In this case, the new toner must be naturally replenished after the completion of an automatic toner adjustment, which is time-consuming.

(3) When the vessel is filled with the initial developing agent and put into the package of the image forming apparatus main body, the developing device must be removed from the main body, and the initial developing agent must be charged thereinto, which is considerably time-consuming. Further, since it is difficult for a user to carry out a developing agent charge job, the user cannot set up the image forming apparatus.

SUMMARY OF THE INVENTION

An object of the present invention, which has been made to overcome the problems of the conventional art described above, is to provide a less expensive image forming apparatus and a set-up method for the image forming apparatus which can reliably prevent the leakage of a developing agent without the need of a special seal structure in packaging and permits a user to easily carry out a set-up job in a short time without trouble.

The present invention, which has been made to achieve the above object, relates to an image forming apparatus and a set-up method for the image forming apparatus for reusing recovered toner collected after toner is used in a developing device of the image forming apparatus by mixing the recovered toner with new toner. The developing device is in an evacuated state before the image forming apparatus is initially set up, and a transfer path of the recovered toner is filled with an initial developing agent which is supplied into the developing device when the image forming apparatus is initially set up. It is preferable that a recovered toner sub-hopper of the recovered toner transfer path be filled with the initial developing agent.

When the image forming apparatus is initially set up, it is preferable that the initial developing agent be automatically and promptly supplied into the developing device by actuating a toner recycle device independently of the image forming apparatus and increasing the operation speed of the toner recycle device.

DESCRIPTION OF THE PREFERRED EMBODIMENTS

Figure 1:
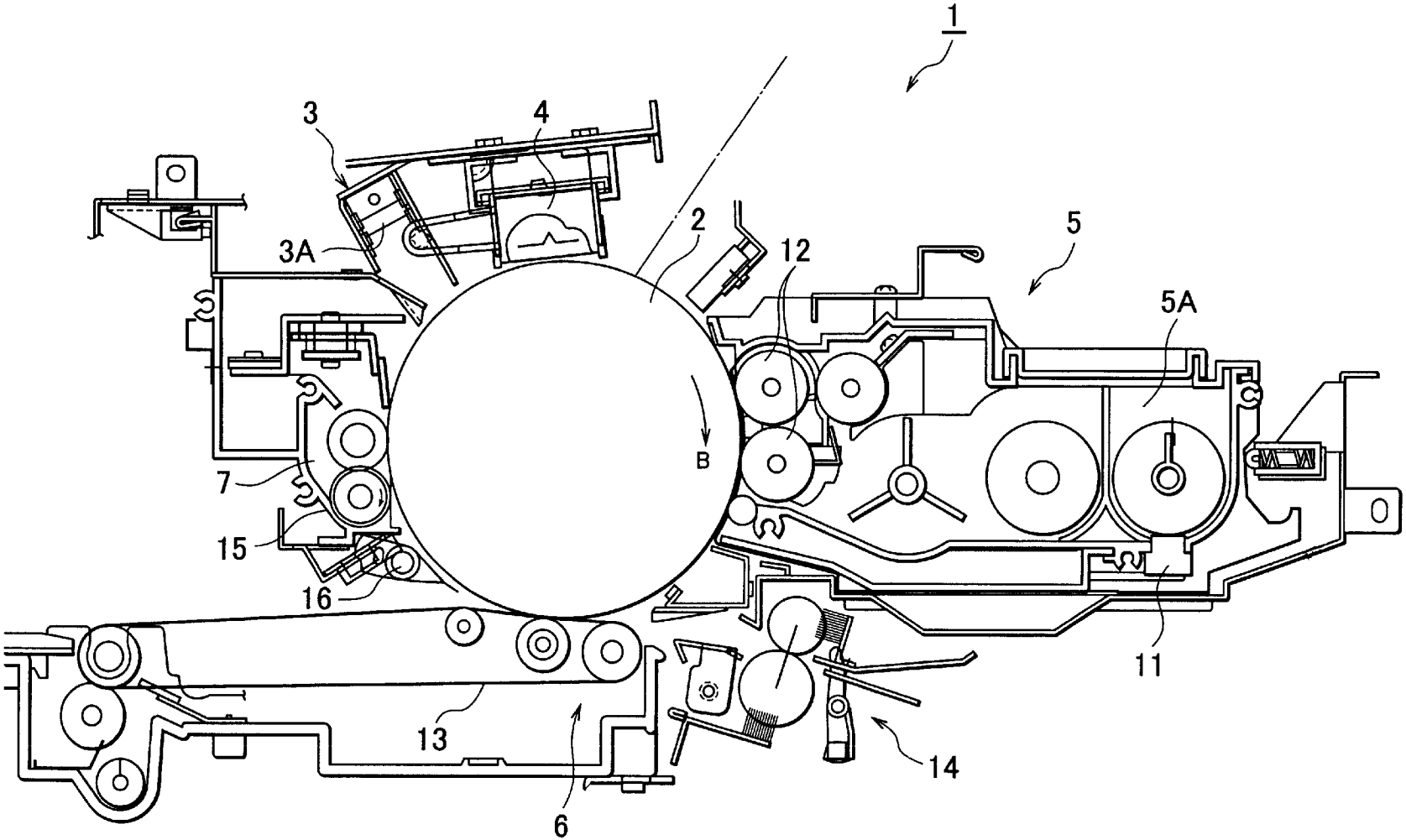
FIG. 1 is a schematic front elevational view showing a main portion of an image forming apparatus of an embodiment of the present invention.

An embodiment of an image forming apparatus and a set-up method for the image forming apparatus according to the present invention will be described below. In the following description, it is assumed that the image forming apparatus of the embodiment is installed on a copying machine. The image forming apparatus assembled in the copying machine is an apparatus for creating an image and transferring the image onto a sheet by a reverse development system based on a document to be copied. An overall structure of the image forming apparatus will be described based on FIGS. 1 to 3.

The image forming apparatus 1 is mainly composed of a photosensitive drum 2, a discharging unit 3, an electrifying charger 4, a developing device 5, a transfer unit 6, a cleaner unit 7, a new toner replenishment device 8 as new toner supply means, and a toner recycle device 9.

The photosensitive drum 2 is a cylindrical drum rotating in one direction (a clockwise direction, that is, a direction of an arrow B in FIG. 1). The photosensitive drum 2 has a surface the charged state of which can be arbitrarily adjusted with laser beams. With this arrangement, an image and the like as data to be transferred can be formed on the surface of the photosensitive drum 2 as a latent image by appropriately adjusting the charged state of an arbitrary portion of the surface of the photosensitive drum 2.

The discharging unit 3 is used to remove charge of the surface of the photosensitive drum 2. The discharging unit 3 includes a discharging lamp 3A. The charge remaining on the surface of the photosensitive drum 2 is entirely removed by impinging the light from the charge removing lamp 3A on the surface, thereby the image forming apparatus prepares for the next print.

The electrifying charger 4 is used to charge the surface of the photosensitive drum 2. The surface of the photosensitive drum 2 negatively charged by the electrifying charger 4 is exposed by the laser beams irradiated from a laser unit (not shown), thereby the latent image is formed on the surface. That is, the surface of the photosensitive drum 2 is exposed with the laser beams based on input information such as an image of a document and the like and a surface potential approaches to zero according to the density of the image and the like, thereby the latent image is formed.

The developing device 5 is a device for adhering a suitable amount of toner onto the surface of the charged photosensitive drum 2. Since a two-component development system is employed here, a carrier and toner are accommodated in the developing device 5, and the ratio of the toner to the carrier is adjusted to about 5 wt %:about 95 wt %. Specifically, the new toner replenishment device 8 and the toner recycle device 9 are appropriately controlled so as to adjust the ratio of the toner to the carrier. The amount of the toner in the developing device 5 is monitored by an automatic toner sensor 11 at all times. When the amount of the toner in the developing device 5 is less than 5 wt %, the new toner replenishment device 8 and the toner recycle device 9 are appropriately controlled by a control unit 70, which will be described later, and a necessary amount of the toner is replenished. The replenished toner and the carrier are stirred by a mixer unit 5A in the developing device 5, and the toner is negatively charged by friction charge when it is stirred. The negatively charged toner is transferred onto the surface of the photosensitive drum 2 by a mag-roller 12 and absorbed by the latent image, thereby a visible image is formed.

The transfer unit 6 is used to transfer the toner, which is absorbed by the latent image on the surface of the photosensitive drum 2, onto a sheet. The transfer unit 6 is mainly composed of a transfer belt 13 and a sheet supply unit 14. The transfer belt 13 transfers and supports the sheet so that sheet comes into contact with the surface of the photosensitive drum 2 and transfers the visual image onto the sheet. The sheet supply unit 14 is disposed so as to face a portion where the transfer belt 13 is in contact with the photosensitive drum 2. The sheet, which is supplied from the sheet supply unit 14 to the portion where the transfer belt 13 is in contact with the photosensitive drum 2, is positively charged and absorbs the negatively charged toner forming the visual image. The sheet onto which the toner has been transferred is supplied to a fixing unit (not shown), and the toner is fusion bonded onto the sheet by thermo compression.

The cleaner unit 7 is used to clean the surface of the photosensitive drum 2. The cleaner unit 7 removes the toner remaining on the surface of the photosensitive drum 2 after the toner has been transferred onto the sheet by the transfer unit 6. The cleaner unit 7 includes a toner receiver 15 and a discharge auger 16 for discharging the toner removed from the surface of the photosensitive drum 2 to the outside. The toner having been removed from the surface of the photosensitive drum 2 drops onto the toner receiver 15 and is discharged to the toner recycle device 9 side by the discharge auger 16.

Figure 2:
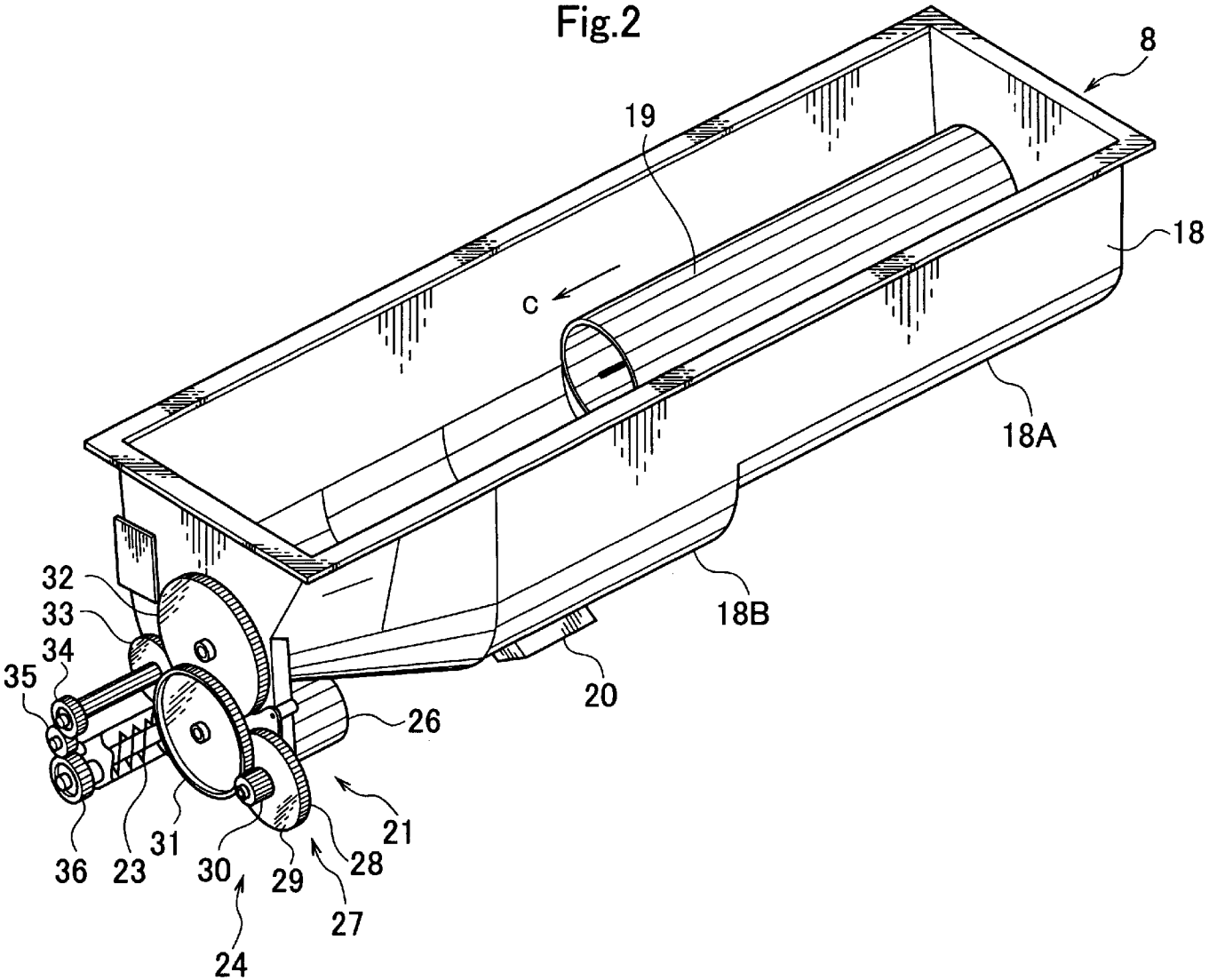
FIG. 2 is a perspective view showing a new toner replenishment device of the embodiment.
Figure 3:
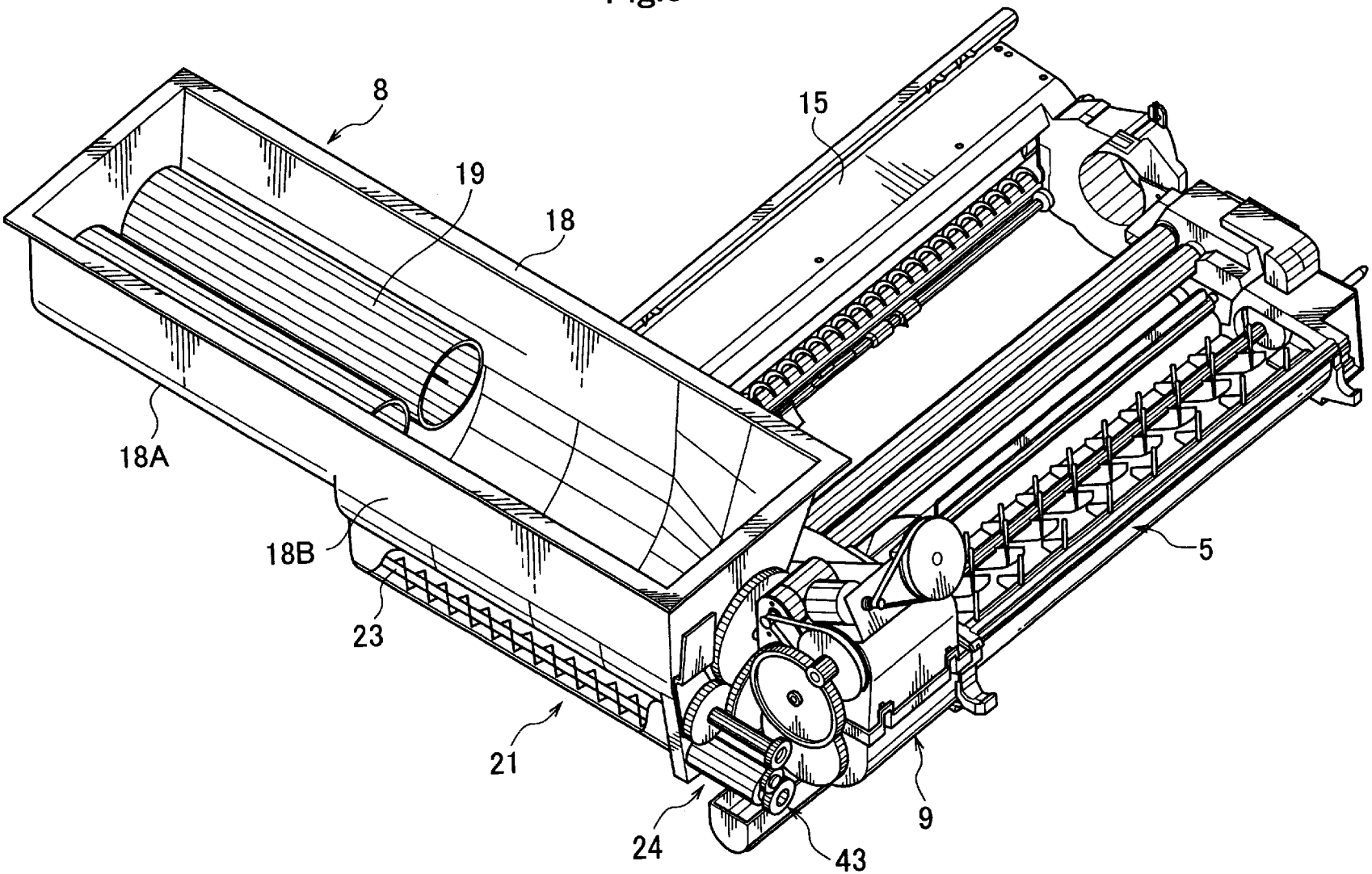
FIG. 3 is a perspective view showing the image forming apparatus of the embodiment.
Figure 4:
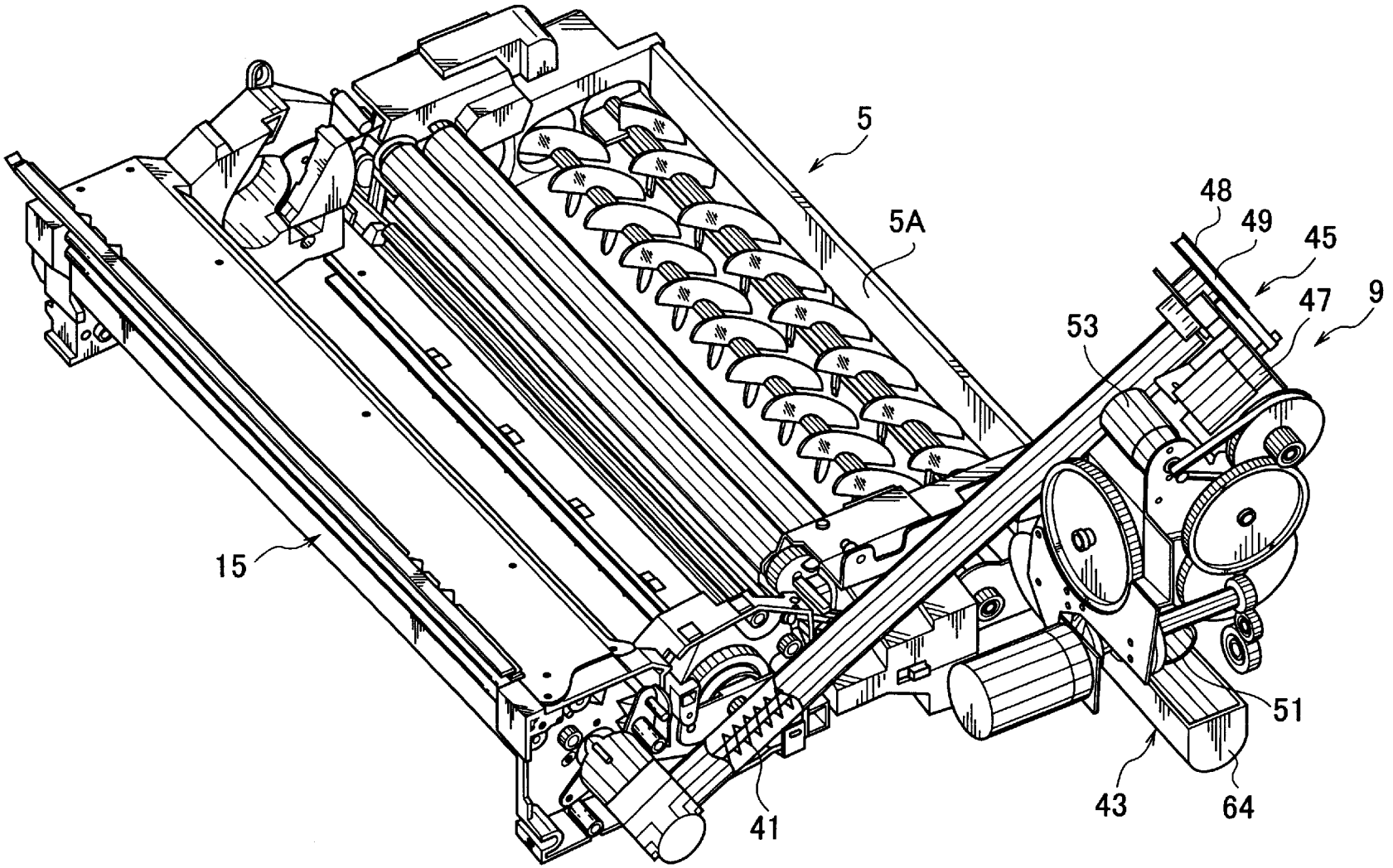
FIG. 4 is a perspective view showing the image forming apparatus of the embodiment excluding the new toner replenishment device.
Figure 5:
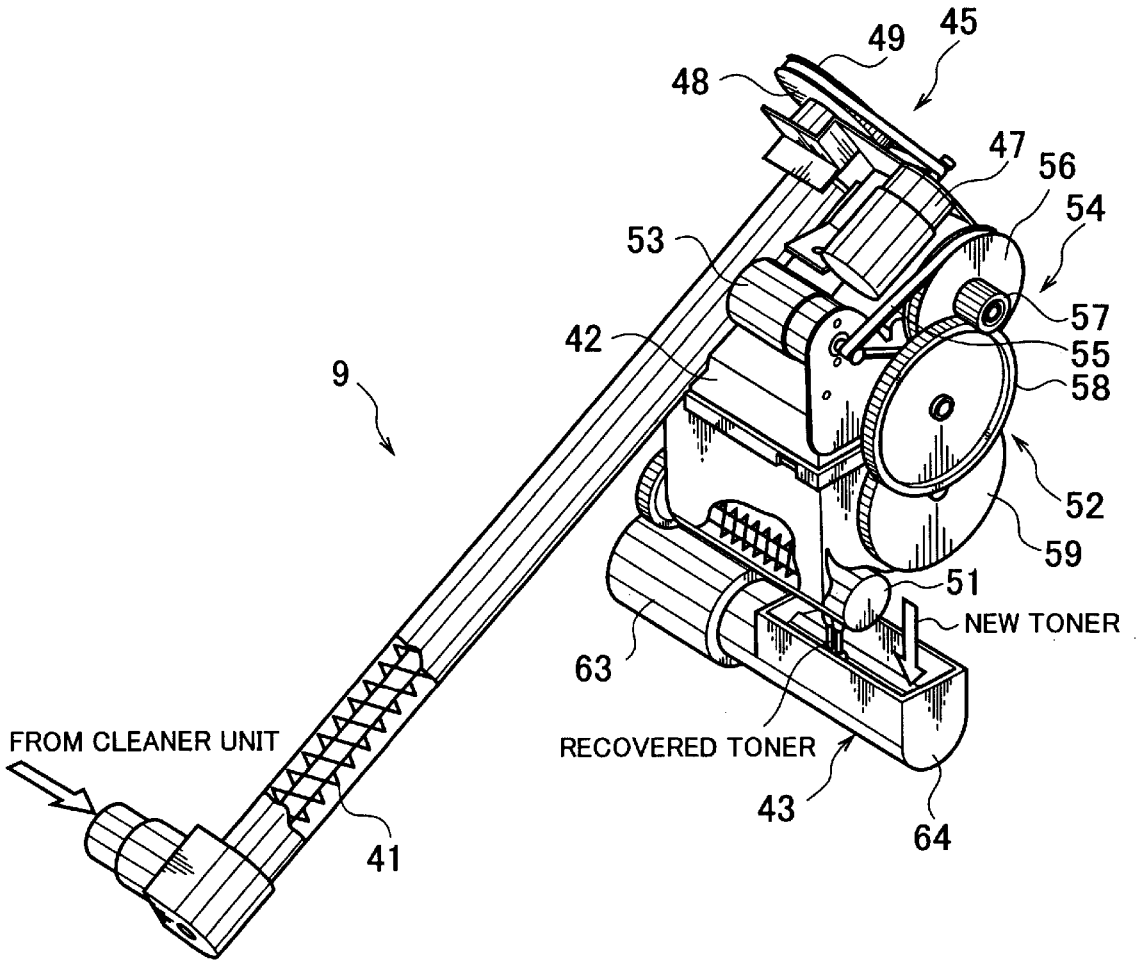
FIG. 5 is a perspective view showing a toner recycle device of the embodiment.
Figure 6:
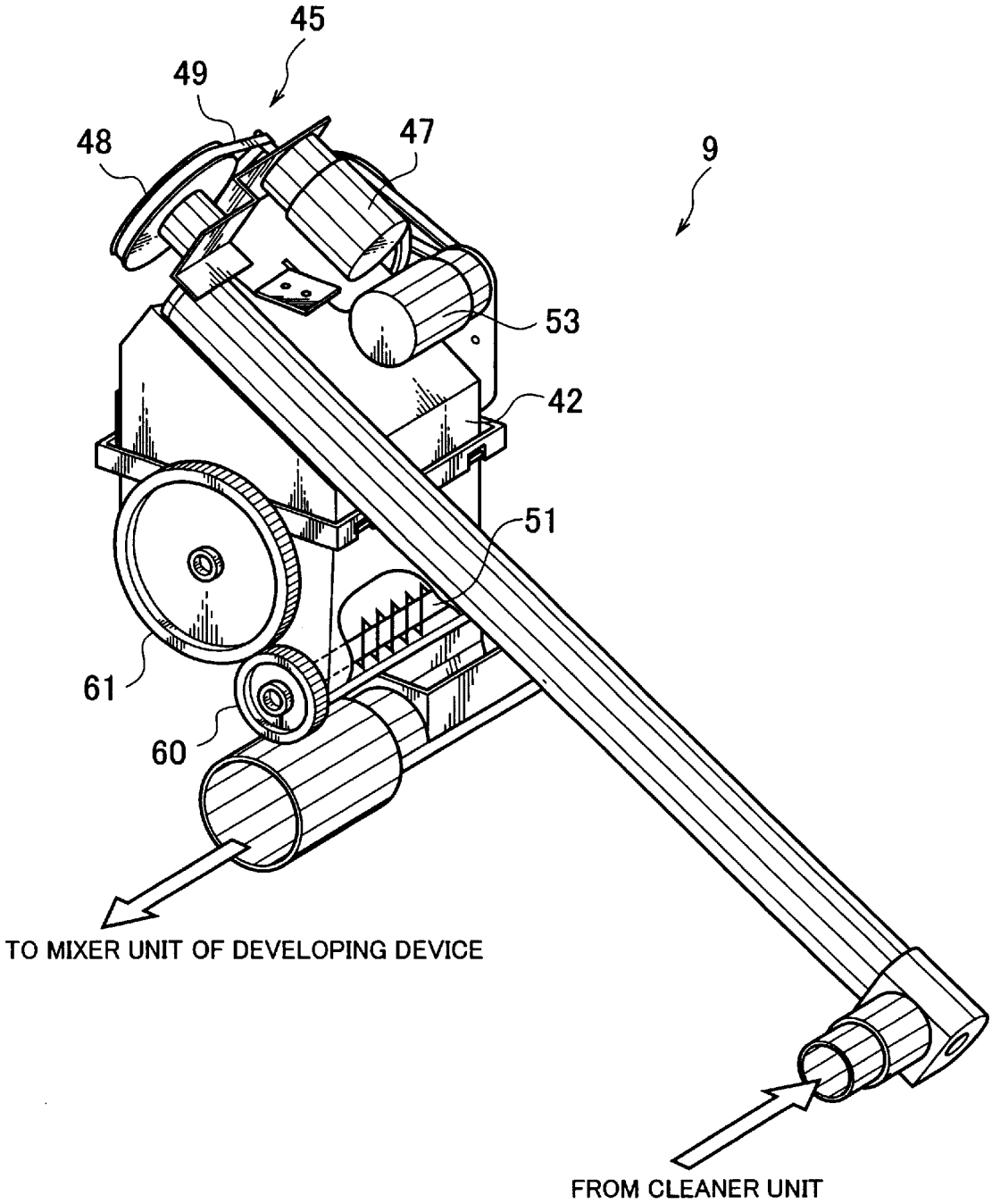
FIG. 6 is a perspective view showing the toner recycle device of the embodiment from a view point different from that of FIG. 5.

The new toner replenishment device 8 is a device for replenishing new toner into the developing device 5. As shown in FIGS. 2 and 3, the new toner replenishment device 8 is disposed in a direction perpendicular to the developing device 5. In this state, the new toner replenishment device 8 is disposed forward of a front surface a main body of the copying machine. The new toner replenishment device 8 is composed of a new toner hopper 18, stir and transfer paddles 19, a remaining toner detection sensor 20, and a conveying unit 21.

The new toner hopper 18 is a vessel for storing new toner. The new toner hopper 18 is composed of an approximately semi-circular vessel having an upper open side. The semi-circular new toner hopper 18 is divided into a shallow bottom section 18A and a deep bottom section 18B at the center of a longitudinal direction. Two sets of the stir and transfer paddles 19 are disposed in the shallow bottom section 18A in parallel with each other. The remaining toner detection sensor 20 and the conveying unit 21 are disposed in the deep bottom section 18B.

The stir and transfer paddles 19 are devices for transferring the new toner stored in the new toner hopper 18 to the conveying unit 21 while stirring it. As described above, the two sets of the stir and transfer paddles 19 are disposed in the shallow bottom section 18A in parallel with each other. When the two stir and transfer paddles 19 rotate, the new toner in the new toner hopper 18 is transferred to the conveying unit 21 in the deep bottom section 18B. The respective stir and transfer paddles 19 are driven by a drive unit (not shown).

The remaining toner detection sensor 20 is a sensor for detecting the remaining amount of the new toner stored in the new toner hopper 18. Since an image cannot be formed if the toner is exhausted, the remaining amount of the toner is detected by the remaining toner detection sensor 20 at all times. Any know sensors such as a magnetic sensor, optical sensor, and the like can be applied to the remaining toner detection sensor 20. They are appropriately selected depending on an accuracy with which the remaining toner is detected.

The conveying unit 21 is used to supply the new toner stored in the new toner hopper 18 into the developing device 5. The conveying unit 21 is composed of a toner transfer auger 23 and an auger drive unit 24. The toner transfer auger 23 is composed of a screw conveyer and disposed on the bottom of the deep bottom section 18B in parallel with the new toner hopper 18. The toner transfer auger 23 is disposed to face a toner receiving plate 64, which will be described later, and supplies the new toner stored in the new toner hopper 18. The auger drive unit 24 is composed of a drive motor (hereinafter, referred to as a "toner hopper motor") 26 and a reducer 27. The toner hopper motor 26 is composed of, for example, a stepping motor. The amount of the new toner to be supplied is accurately controlled by controlling the number of rotation and the period of time of rotation of the toner transfer auger 23 by the toner hopper motor 26. The reducer 27 is composed of a belt 28, a pulley 29, and gears 30 to 36. The gears 30 to 36 are appropriately regulated according to a speed reduction ratio. Stirring bars (not shown) disposed in the deep bottom section 18B are attached to a rotating shaft of the gear 32.

The toner recycle device 9 is used to transfer the recovered toner collected by the cleaner unit 7 to the developing device 5 in order to reuse it. The toner recycle device 9 is disposed below the new toner replenishment device 8 approximately in parallel with it. As shown in FIGS. 3 to 6, the toner recycle device 9 is composed of a recovered toner coupling and transfer auger 41 acting as a coupling and transfer unit, a recovered toner sub-hopper 42 acting as recovered toner accommodation means, and a supply auger 43.

The recovered toner coupling and transfer auger 41 is used to transfer the toner collected by the cleaner unit 7 to the developing device 5 side. The recovered toner coupling and transfer auger 41 is composed of, for example, a long screw conveyer, the lower end of the auger 41 is coupled with the discharge auger 16 of the cleaner unit 7, and the upper end thereof is coupled with the recovered toner sub-hopper 42. A drive unit 45 of the recovered toner coupling and transfer auger 41 is composed of a drive motor 47 disposed adjacent to the upper end of the recovered toner coupling and transfer auger 41, a pulley 48 coupled with the recovered toner coupling and transfer auger 41, a belt 49 for coupling the drive motor 47 with the pulley 48, and the like. The drive motor 47 is controlled in association with a drive motor of the discharge auger 16 of the cleaner unit 7.

The recovered toner sub-hopper 42 is a vessel for temporarily storing the recovered toner collected by the recovered toner coupling and transfer auger 41 and supplying a necessary amount of it into the developing device 5. Stirring bars (not shown) are disposed in the recovered toner sub-hopper 42 to stir the recovered toner stored therein. A recovered toner replenishment auger 51 acting as recovered toner replenishment means is disposed to the lower portion in the recovered toner sub-hopper 42. The rotation of the recovered toner replenishment auger 51 is controlled by a drive unit 52 so that the recovered toner can be supplied to the supply auger 43 in an accurate amount. The drive unit 52 is composed of a drive motor (sub-hopper motor) 53 and a reducer 54. The sub-hopper motor 53 is composed of, for example, a stepping motor. The reducer 54 is composed of a combination of a belt 55, a pulley 56, and gears 57 to 61. The gears 59 and 60 are disposed on both the sides of the recovered toner sub-hopper 42 across it and coupled with each other through a single rotating shaft, and stir bars (not shown) are attached to the rotating shaft.

The recovered toner sub-hopper 42 is filled with an initial developing agent in a manufacturing process of the copying machine or when the copying machine is shipped. A lid of the recovered toner sub-hopper 42 is removed, and the initial developing agent is filled in the recovered toner sub-hopper 42. Since the recovered toner sub-hopper 42 has an excellent seal property, the initial developing agent does not leak to the outside due to vibration and the like while it is transported. Note that the new toner replenishment device 8 is filled with new toner in the manufacturing process of the copying machine or when the copying machine is shipped. Since the new toner replenishment device 8 also has an excellent seal property, the new toner does not leak to the outside due to vibration and the like while it is transported.

The supply auger 43 is used to receive the recovered toner from recovered toner replenishment auger 51 and the new toner from the toner transfer auger 23 of the new toner replenishment device 8 and supplies them into the developing device 5. The supply auger 43 is composed of an auger unit 63 formed by being extended from the mixer unit 5A of the developing device 5, the recovered toner replenishment auger 51 of the toner recycle device 9, and a toner receiving plate 64 that opens toward the toner transfer auger 23 of the new toner replenishment device 8. A drive motor (not shown) of the auger unit 63 is disposed on the developing device 5 side. The recovered toner replenishment auger 51 is disposed on the developing device 5 side. In the toner receiving plate 64, the new toner from the toner transfer auger 23 of the new toner replenishment device 8 is supplied upstream of the recovered toner from the recovered toner replenishment auger 51. The new toner and the recovered toner having been replenished to the toner receiving plate 64 are mixed with a carrier and stirred in the mixer unit 5A of the developing device 5.

Figure 7:
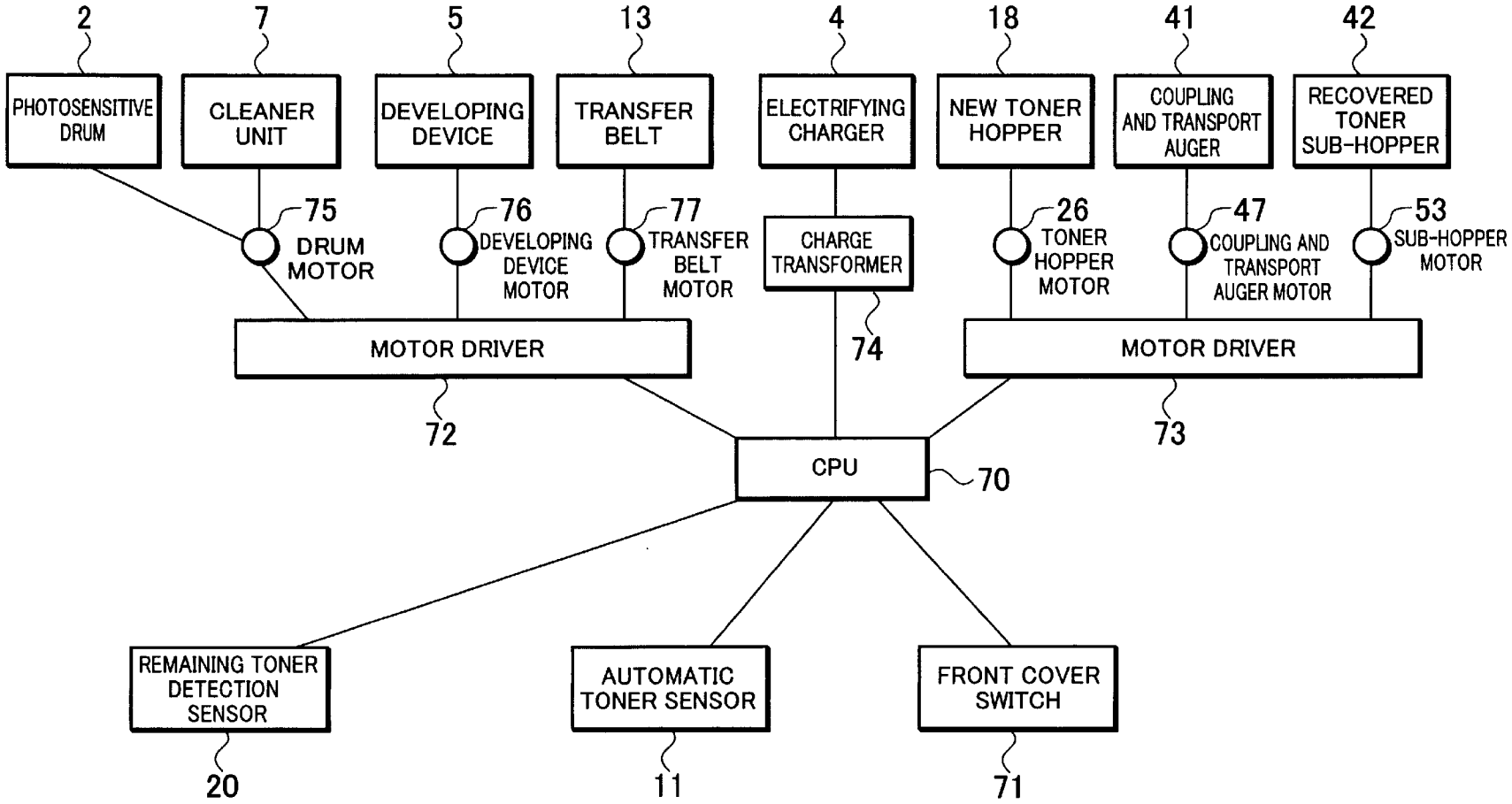
FIG. 7 is a block diagram showing a control arrangement of the image forming apparatus of the embodiment.

FIG. 7 is a block diagram showing a control arrangement of the image forming apparatus 1 of the embodiment.

A controller (shown as a CPU in FIG. 7) 70 is composed of, for example, a CPU, ROM, RAM, and the like and controls the image forming apparatus 1 in its entirety based on a processing program stored in the ROM, RAM, and the like and according to data stored in the ROM, RAM, and the like and to the outputs from various sensors.

The remaining toner detection sensor 20 and the automatic toner sensor 11 described above are connected to input ports of the controller 70 as well as a front cover switch 71 is connected to the sensor 20.

The remaining toner detection sensor 20 detects the amount of the new toner remaining in the new toner hopper 18 as described above, and a magnetic sensor composed of a magnet and a lead switch, for example, can be applied to the remaining toner detection sensor 20. When the new toner remains in a large amount, the new toner enters between the magnet and the lead switch and a gap is formed therebetween, thereby the lead switch is turned off. In contrast, when the new toner remains in a small amount, no gap is formed therebetween, thereby the lead switch is turned on by the attracting force of the magnet. The controller 70 detects the turning-on and the turning-off of the lead switch.

The automatic toner sensor 11 is a toner density ratio sensor for detecting the ratio of the toner (resin) to the carrier (iron) in a developing agent, as described above. The output from the automatic toner sensor 11 is read by the controller 70. When a toner density drops, the controller 70 drives the toner hopper motor 26 and the like so that the toner is replenished into the developing device 5 and notifies a user of a lack of toner, and the like by displaying it on a control panel (not shown) and the like.

The front cover switch 71 is a switch that is turned on and off by opening and closing a main body cover (here, referred to as a "front cover") of the copying machine. The output signal from the front cover switch 71 is read by the controller 70, thereby the controller 70 recognizes a state of the front cover.

The output ports of the controller 70 are connected to the two motor drivers 72, 73 and a charge transformer 74.

The photosensitive drum 2 and the cleaner unit 7 are driven by a drum motor 75, which is driven in rotation by the motor driver 72, under the control of the controller 70 when a copy or the like is executed.

Likewise, the developing device 5 and the transfer belt 13 are driven by a developing device motor 76 and a transfer belt motor 77, which are driven in rotation by the motor driver 72, under the control of the controller 70 when the copy or the like is executed.

Further, likewise, the new toner hopper 18, the recovered toner coupling and transfer auger 41, and the recovered toner sub-hopper 42 are driven by the toner hopper motor 26, the coupling and transfer auger motor 47, and the sub-hopper motor 53, respectively, which are driven in rotation by the motor driver 73.

Note that while the toner hopper motor 26, the coupling and transfer auger motor 47, and the sub-hopper motor 53 are connected to the same motor driver 73, they can be driven individually under the control of the controller 70.

As described above, the electrifying charger 4 is applied with a high voltage by the charge transformer 74 under the control of the controller 70 and charges the photosensitive drum 2 when the copy and the like are made.

Figure 8:
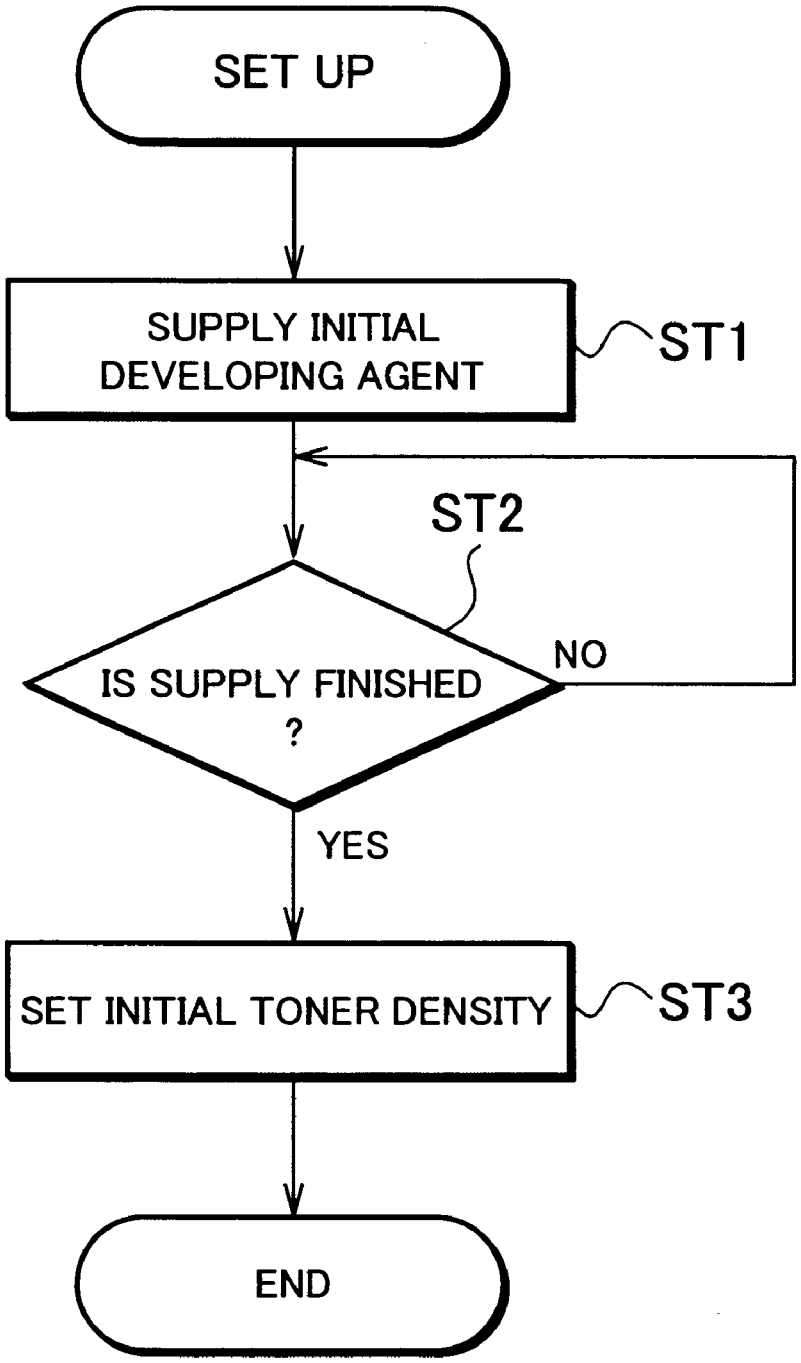
FIG. 8 is a flowchart showing a processing function when the image forming apparatus of the embodiment is set up.

In addition, the controller 70 stores a set-up processing function shown in a flowchart of FIG. 8 together with the processing function (not shown) for controlling the image forming apparatus 1 in its entirety. The set-up processing function is set as a subroutine which functions only once when the apparatus 1 is setup. Specifically, whether or not set-up processing is to be executed is determined at the beginning of the processing flow for controlling the image forming apparatus 1 in its entirety, and the set-up processing shown in FIG. 8 is executed only once when the apparatus 1 is set up.

Next, a set-up method the image forming apparatus 1 arranged as described above of the copying machine will be described.

The set-up processing is executed just after the processing for controlling the image forming apparatus 1 in its entirety is started by turning on a main switch for the first time. That is, the copying machine is installed at a predetermined position, power is supplied thereto, and the main switch is turned on. With this operation, the processing flow for controlling the image forming apparatus 1 in its entirety is started as described above, and it is determined that the set-up processing must be executed at the beginning of the processing flow. With this determination, the set-up processing in FIG. 8 is stated only once when the apparatus 1 is set up.

When the set-up processing starts, the sub-hopper motor 53 of the recovered toner sub-hopper 42 of the toner recycle device 9, the drive motor of the auger unit 63, and the drive motor of the mixer unit 5A of the developing device 5 are driven (step ST1). With this operation, the initial developing agent in the recovered toner sub-hopper 42 is supplied to the auger unit 63, further supplied into the developing device 5 by the auger unit 63, and stirred by the mixer unit 5A of the developing device 5. At this time, the sub-hopper motor 53 of the recovered toner sub-hopper 42 and the drive motor of the auger unit 63 are driven at a rotational speed higher than an ordinary rotational speed, thereby the initial developing agent in the recovered toner sub-hopper 42 is promptly supplied into the developing device 5 in a short time.

Next, the process waits until all the initial developing agent in the recovered toner sub-hopper 42 is supplied into the developing device 5 (step ST2). Specifically, the remaining amount of the initial developing agent in the recovered toner sub-hopper 42 is detected by a recovered toner remaining amount detection sensor (not shown) disposed in the recovered toner sub-hopper 42, and the process waits until the initial developing agent is exhausted. The initial developing agent supplied into the developing device 5 is stirred by the mixer unit 5A and reaches the mag-roller 12.

When the supply of the initial developing agent in the recovered toner sub-hopper 42 is completed, an initial toner density is set (step ST3). The toner density of the initial developing agent is detected by the automatic toner sensor 11 and set as preference value for automatic toner adjustment. Here, the reference value is set to 5%.

On the completion of the initial toner density, the process waits that the image forming apparatus 1 is controlled in its entirety. Then, a job for installing the copying machine is finished without the need of filling new toner because the new toner hopper 18 is already filled with the new toner.

Thereafter, the toner recycle device 9 executes an ordinary function. That is, the recovered toner sub-hopper 42 acts as a vessel for temporarily storing the recovered toner. The toner recycle device 9 supplies to the developing device the recovered toner in the recovered toner sub-hopper 42 only in a necessary amount when it is required.

As described above, when the copying machine is packaged, the recovered toner sub-hopper 42 of the toner recycle device 9 is filled with the initial developing agent and the developing device 5 is not filled with it. Accordingly, even if a special seal mechanism is not provided when the copying machine is packaged, the leakage of the developing agent can be prevented with reliability during the transportation, and the like thereof. As a result, the toner recycle device 9 can be provided at a less expensive cost.

Further, since the new toner hopper 18 is not filled with the initial developing agent, it is possible for the new toner hopper 18 to be filled with the new toner when the product is shipped. Accordingly, a new toner filling job is not necessary when the apparatus 1 is set up.

Moreover, since a set-up job can be carried out only by pressing the main switch without the need of filling an initial developing agent and new toner, the set-up job can be easily executed without trouble. As a result, even the user can execute set-up job.

Note that while the recovered toner sub-hopper 42 is filled with the initial developing agent in the above embodiment, other portion may be filled with the initial developing agent, in addition to the recovered toner sub-hopper 42. As long as a portion filled with the initial developing agent is located within a recovered toner transfer path in the toner recycle device 9, the initial developing agent can be supplied into the developing device 5 by actuating the toner recycle device 9, thereby the same operation/working effect as that of the above embodiment can be achieved. For example, the initial developing agent may be stored in the recovered toner coupling and transfer auger 41, or in the recovered toner coupling and transfer auger 41 and the recovered toner sub-hopper 42. When the initial developing agent is stored also in the coupling and transfer auger 41, the initial developing agent in the coupling and transfer auger 41 is supplied into the recovered toner sub-hopper 42 and the initial developing agent in the recovered toner sub-hopper 42 is supplied into the developing device 5 by actuating the overall toner recycle device 9 when the apparatus 1 is set up.

Further, in the above embodiment, the initial toner density is set by executing the set-up processing by turning on the main switch, the set-up processing and the initial set of the toner density may be executed using the selection of an automatic toner adjustment mode as a trigger. That is, when the automatic toner adjustment mode, in which the toner density of the developing agent is automatically set to a set value, can be arbitrarily selected manually, the above processing may be executed using the selection of the automatic toner adjustment mode as the trigger. The same operation/working effect as that of the above embodiment can be achieved also in this case.

Also, in the above embodiment, the example in which the new toner replenishment device 8 is used as means for replenishing the new toner, new toner replenishment means using a cartridge may be also applied to the present invention. The same operation/working effect as that of the above embodiment can be achieved also in this case.

Also, while the mixture of the toner and the carrier is used as the developing agent, only the toner may be used. The same operation/working effect as that of the above embodiment can be achieved also in this case.

While the copying machine is described as an example in the above respective embodiments, the application of the image forming apparatus is by no means limited to the copying machine, and the apparatus can be applied to any other equipment for forming an image using toner such as a printer, facsimile and the like.

Further, the image forming apparatus can be also applied to a color copying machine. In this case, the image forming apparatus is applied to each of four sets of the image forming apparatuses 1 for three primary colors and black.

What is claimed is:

1. An image forming apparatus having a toner recycle device for supplying recovered toner from a cleaner unit into a developing device through a transfer path and reusing the recovered toner by mixing it with new toner, comprising control means for causing an initial developing agent filled in the transfer path before the image forming apparatus is initially set up to be supplied into the developing device when the image forming apparatus is initially set up.

2. The image forming apparatus according to claim 1, wherein the transfer path comprises recovered toner accommodation means for temporarily storing the recovered toner and coupling and transfer means for transferring the recovered toner from the cleaner unit to the recovered toner accommodation means, and one of the coupling and transfer means and the recovered toner accommodation means is filled with the initial developing agent.

3. The image forming apparatus according to claim 2, wherein the toner recycle device comprises recovered toner supply means, and the control means controls the recovered toner supply means so that the recovered toner is supplied into the developing device when an image is formed as well as the initial developing agent is supplied into the developing device when the image forming apparatus is initially set up.

4. The image forming apparatus according to claim 3, wherein the control means increases the operation speed of the recovered toner supply means when the image forming apparatus is initially set up more than when an image is formed.

5. The image forming apparatus according to claim 3, comprising toner density detection means, wherein the control means controls the toner density detection means so that the toner density detection means sets an initial toner density by detecting the toner density of the initial developing agent after the initial developing agent has been supplied into the developing device and by setting the detected toner density as an adjustment reference value.

6. A set-up method for an image forming apparatus having a toner recycle device for supplying recovered toner from a cleaner unit into a developing device through a transfer path and reusing the recovered toner by mixing it with new toner, the method comprising the step of supplying an initial developing agent filled in the transfer path before the image forming apparatus is initially set up into the developing device when the image forming apparatus is initially set up.

7. The set-up method for an image forming apparatus according to claim 6, wherein the transfer path comprises recovered toner accommodation means for temporarily storing the recovered toner and coupling and transfer means for transferring the recovered toner from the cleaner unit to the recovered toner accommodation means, and one of the coupling and transfer means and the recovered toner accommodation means is filled with the initial developing agent.

8. The set-up method for an image forming apparatus according to claim 7, wherein the toner recycle device comprises recovered toner supply means, and the control means controls the recovered toner supply means so that the recovered toner is supplied into the developing device when an image is formed as well as the initial developing agent is supplied into the developing device when the image forming apparatus is initially set up.

9. The set-up method for an image forming apparatus according to claim 8, wherein the control means increases the operation speed of the recovered toner supply means when the image forming apparatus is initially set up more than when an image is formed.

10. The set-up method for an image forming apparatus according to claim 8, comprising toner density detection means, wherein the control means controls the toner density detection means so that the toner density detection means sets an initial toner density by detecting the toner density of the initial developing agent after the initial developing agent has been supplied into the developing device and by setting the detected toner density as an adjustment reference value.

* * * * *